US007692081B2

(12) United States Patent
Bauer et al.

(10) Patent No.: US 7,692,081 B2
(45) Date of Patent: Apr. 6, 2010

(54) WIND CHIME APPARATUS AND METHOD

(76) Inventors: Ann Garth Bauer, 4003 Narragansett Ave., San Diego, CA (US) 92107; David Beckett, 5215 Genesee Cove, #25, San Diego, CA (US) 92122

( * ) Notice: Subject to any disclaimer, the term of this patent is extended or adjusted under 35 U.S.C. 154(b) by 0 days.

(21) Appl. No.: 11/805,629

(22) Filed: May 24, 2007

(65) Prior Publication Data

US 2007/0272072 A1 Nov. 29, 2007

Related U.S. Application Data

(60) Provisional application No. 60/808,497, filed on May 25, 2006.

(51) Int. Cl.
*G10D 13/08* (2006.01)

(52) U.S. Cl. ..... 84/402

(58) Field of Classification Search ..... 84/402–410
See application file for complete search history.

(56) References Cited

U.S. PATENT DOCUMENTS

| | | | | |
|---|---|---|---|---|
| 493,066 | A * | 3/1893 | Carpigiani | 84/402 |
| 5,648,624 | A * | 7/1997 | Smith | 84/404 |
| 2002/0117043 | A1 * | 8/2002 | Powley | 84/483.2 |

* cited by examiner

*Primary Examiner*—Kimberly R Lockett
(74) *Attorney, Agent, or Firm*—Mayer & Williams PC; Mark D. Wieczorek, Esq.

(57) ABSTRACT

Wind Chimes are provided, the notes of which are tuned to play a person's given name, according to the Ogham notation. The "tune" of the person's name is played on, e.g., anodized aluminum tubes, which are tuned to specific notes, based on the ancient system. The name being "played" is written on one side of the frame in English, and on the other side using the Ogham characters that translate as both the English letters, and the musical notes. The shape of the chime's frame is patterned after a Harp. The instrument can be used traditionally, as a wind chime, or it can be fitted with a base, allowing it to be used indoors as a décor item.

9 Claims, 2 Drawing Sheets

– MacAlister, in "The Secret Languages of Ireland," assigns it the value of "V"

- MacAlister and Edwards (The Archaelogy of Early Medieval Ireland) assign it the value of "X"

- Edwards assigns it the value of "K"

- Edwards assigns it the value of "P"

- MacAlister and Edwards assign it the value of "Z"

- Damian McManus (A Guide to Ogam) assigns the value of "Y"

WIND CHIME APPARATUS AND METHOD

STATEMENT OF RELATED APPLICATION

This application claims the benefit of U.S. Provisional Patent Application Ser. No. 60/808,497, filed May 25, 2006, entitled "Wind Chime", which is incorporated by reference in its entirety herein.

BACKGROUND

The harp is the oldest known stringed instrument. The word "harpa" or "harp" comes from Anglo-Saxon, Old German, and Old Norse words meaning, "to pluck". The earliest drawings of triangular-frame harps appear in the Utrecht Psalter, written and illustrated in the early 9th century. Though it seems from the evidence that the triangular harp appeared first in Scotland, it is reported by Geraldus Cambrensis in the late 12th century that the Irish were by then playing harps with brass, or bronze, strings. Replicas of Pictish harps are found on a sandstone carved cross at Dupplin Castle, Perthshire from the late 9th or early 10th century.

The earliest Gaelic term for a wire-strung instrument was cruit. By 1200 this term was also being applied specifically to the triangular harp. A later word used in Scotland and Ireland for the harp was clarsach, or cláirseach. The harper and reciter (reacaire) traveled in aristocratic circles, entertaining at the court of Celtic kings and leaders of clans. Their songs composed a library of unwritten stories that were handed down from teacher to student. Some of the songs were popular enough to be saved as manuscripts (for the lute), but most of the music was buried with the harpers.

The earliest drawings of triangular-frame harps appear in the Utrecht Psalter, written and illustrated in the early 9th century. Ten of the illustrations show figures holding harp-like instruments.

Manuscript illustrations of the 11th century show a more developed harp with a deeper sound box and a rounded shoulder at its junction with the neck. Harps found in Scottish stone carvings of this time have a similar shape. Pictish harps are carved on a sandstone cross at Dupplin Castle, Perthshire, from the late 9th or early 10th century.

Thus harps were of high importance in the early Medieval period.

Ogham is an early Irish linear script. It uses a central line and indicates letters as strokes on either side or passing through the central line. In its basic form it consists of 20 letters divided into 4 groups (Irish aicme) of 5 letters. The beginning letter of each aicme has only one stroke, the second aicme has two, etc. What differentiates each aicme is the type of stroke it includes. Two aicmes are strokes emerging from the central line and coming from opposite sides. The other two aicmes feature strokes completely through the central line with differing angles of the stroke. Various of these are shown in FIG. 1.

The antiquity of the system goes back at least to Julius Caesar, for he refers to it when he writes about the Gallic wars. Scholars, however, are divided as to its origins. Debate continues as to whether Ogham has links its roots in Latin, Greek, early Germanic or a number of other possibilities.

What is known for certain is that the usage of Ogham began in Ireland and that remained the area of its highest concentration. There are 369 stones extant that bear inscriptions in Ogham, they are in Wales, Cornwall, Scotland, the Orkney and Shetland Islands as well as Brittany. But, by far, the area with the most inscribed stones is Ireland. However, it is worth noting that all the places that Ogham stones are found are Celtic countries.

Most scholars agree that between the 5th and 9th centuries another aicme was added to the previous 4 aicmes. These are extra letters or forfeda, and these are indicated in FIG. 2.

Most of our knowledge about the alphabet comes from the 14th century manuscript known as the Book Of Ballymote, translated and published with annotations by Alexander Calder in 1907.

A feature of Ogham is that, in addition to its usage as an alphabet, it was used as a mnemonic and counting system as well. Each letter could also be connected to a particular word, a way to remember important information. In Linnogham, each letter corresponds to the first letter of an Irish river. A similar system is applied to remember famous fortresses (Dinnogham), birds (Enogham), colors (Dathogham), churches (Ceallogham) and so on.

Ogham was also used to count. In Damogham, each of the four aicmes represented a different type of cattle: bulls, oxen, bullocks and steers. And each letter of each aicme represented a number (from one to five) of the type of cattle represented by that particular aicme. There were Oghams to count cows (Boogam), bodies of water (Ogham Usceach), dogs (Conogham), deer (Osogham), boats (Ogham n-eathrach) and many others.

Since Ogham was used as a counting and mnemonic aid to assist in so many vital areas of daily life, it seems logical that it would also have a musical function. Music was extremely important to the ancient Irish and every musical system relies upon some organizing principal. Unfortunately, the Book Of Ballymote, which is our chief source for our knowledge of Ogham, does not directly link the two.

By the mid nineteenth century, however, scholars were convinced that there must be a correlation between Ogham and music. In 1857 the Journal Of The Royal Society Of Anitquaries suggested that three of the Ogham strokes were identical with musical signs.

By 1905 W. H. Grattan Flood, writing in his book, "A History Of Irish Music," states that an Ogham carving known as the Bressay inscription "furnishes an early example of music scoring; an it is quite apparent that the inscriber regarded the ogham and the quaint tablature employed as one and the same."

No scholar, however, could offer a key to deciphering all the Oghams in terms of musical pitches.

SUMMARY OF THE INVENTION

Embodiments of the invention provide wind chimes that have resonating members that "spell out" a person's name, both in terms of visual representations of the letters of the person's name and also in terms of the musical notes that are associated with the letters in the person's name. Thus, when the chimes ring in the wind, a musical representation of the person's name is heard.

DETAILED DESCRIPTION

Figure 1:
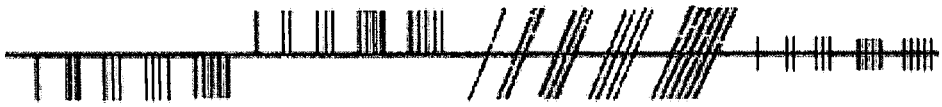
FIG. 1 shows various aicmes.
Figure 2:
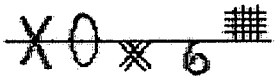
FIG. 2 shows later-added letters or forfeda.

The present inventors have synthesized various theories into a possible scenario for the evolution of the harp-Ogham connection. The first Irish harps were four sided instruments almost box like, not the triangular shape we are familiar with today. The classic reference book for this is The Irish Harp by Joan Rimmer (Clo Mercier, Corcaich, 1977). In this work Ms. Rimmer did an iconographical study of harps depicted on high crosses of early Ireland.

The number of fingers on the human hand and the number of letters in each aicme of the Ogham alphabet is 5. The earliest form of Ogham consisted of 4 aicmes, or 20 letters (5 more, the forfeda were added later). We would expect, therefore, that the first harp-like instruments would utilize strings in divisions of ten or twenty and later on include twenty-five strings.

In 1792 Edward Bunting attended a festival of Irish harpers. He transcribed what he heard and saved a corpus of music for the world that otherwise might have been lost forever. He wrote extensively about the harpers and their instruments. One curiosity was that the harps had two G strings in the bass. They were called the "sisters". Their exact purpose was unclear.

In 1988, writing in Miscellanea Musica Celtica James Travis suggested that "The pair of strings termed 'the sisters', which were tuned in unison and divided bass and treble, may be justifiably explained as the equivalent of what once had been the highest string of one instrument and the lowest string of another that was played in concert with the first".

If this were true, and if the concept of Oghams being used musically were also true, the inventors posited that was may be logically expected that early harp-like instruments would have ten strings and one would play the treble the other the bass. Elsewhere, regarding the two separate instruments Travis states "(technically this type of music indicates) strong evidence the musicians who created the style of the music employed separate instruments, of eight or ten strings for the bass and treble parts."

If the origin of the "sisters" does indeed lie in two early harp-like instruments (or cruits) and they had ten strings, it would fit in with the concept of naming the strings with Ogham letters. Of course, historically the advent of Christianity brought another musical influence. Traveling clerics in Ireland carried with them 8 stringed harps that would accompany the chants of the western church. However, 10 stringed instruments also existed side by side, much as the new Church coexisted with the ancient druid religious system.

Around the 10th century the triangular harp began to achieve prominence in Ireland. Gradually the smaller cruit would be overshadowed by the new instrument.

In the early 1600's a musician, Robert ap Huw, transcribed a series of ancient Welsh documents. It became known as the "Ap Huw Manuscript". It consists of a series of laws regulating the profession of music titled the "Statute of Gruffydd ap Cynan" along with a series of 24 measures of music designed to be a guide to proper musical practice.

Gruffydd was a king of Wales and his father had come from Ireland in 1040 A.D. Cynan (the father) had brought with him from Ireland musical instruments and musicians. It is probable that all four of the chief musicians who assisted in the creation of the Statute came from Ireland. The twenty-four measures reflected Irish musical practices, even the tablature used was Irish. What is important for the purpose of this paper is that the technical features of the pieces reflect Irish music at that time. And significantly, according to "New Grove dictionary Of Music And Musicians", the 24 measures require a harp with 25 strings!

It would seem that the two cruits had been combined into one larger triangular shaped instrument and more notes added (possibly the forfeda).

Although many other influences affected Irish music, it is likely that the first harps were smaller instruments with 5 to 10 strings and the strings were named according to the Oghams. Later on, as the 5 additional letters came to be added to the alphabet, the harps combined to become one, which encompassed 25 strings.

According to Irish myth the greatest of the gods was Dagda. He possessed a magic harp called "the Four-Angled music." Scholars were puzzled by the meaning of the phrase until discoveries pointed to the earliest of harp-like instruments as being a quadrangle in shape. Then it became clear that the "Four-Angled music" was a harp of four sides.

As noted previously, the Book Of Ballymote contains Oghams for designating a wide variety of items featured in daily life, cows, rivers, trees, birds, but nothing specifically related to music.

However, there is one Ogham that may actually refer to the harp, although it has not been recognized as such until now: Ogham number sixty-seven. It is Bacogam, that is, bend or angle Ogham. If the greatest of the gods had a magic harp called the "Four-Angled music" it certainly is reasonable to assume that an Ogham devised to represent the harp would mirror the instrument itself. This may be the real meaning of Bacogam. Further, according to the myths Dagda had a son, his name was Ogma and he was the god who invented the Ogham system of writing.

Figure 3:
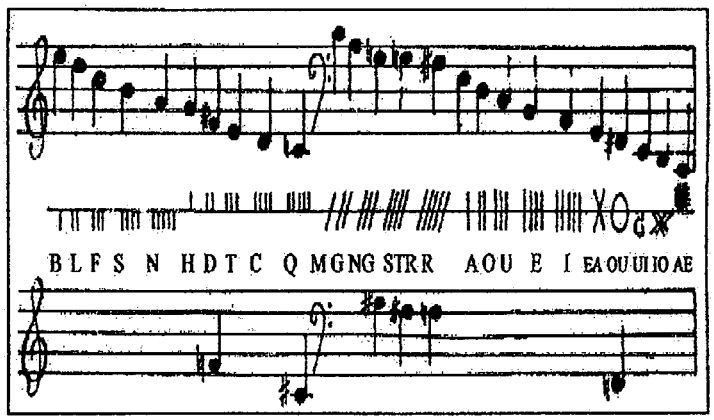
FIG. 3 is Sean O'Boyle's tonal interpretation of the Ogham alphabet.

FIG. 3 is Sean O'Boyle's tonal interpretation of the Ogham alphabet. There are two lines. O'Boyle felt that certain pitches were routinely raised or lowered depending on the need. The notes that could be adjusted are given on the second line. In those cases the inventors have devised that the "natural" version of the pitch may be one embodiment, rather than the inflected version.

Figure 4:
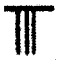
FIG. 4 shows a partial listing of the inventors' synthesis and assignment of letters to oghams.
Figure 4:
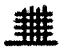
Figure 4:
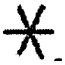
Figure 4:
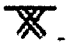
Figure 4:
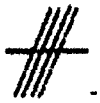
Figure 4:
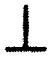

As is often the case, there is disagreement among scholars as to the exact meaning of all the ogham letters. The inventors have synthesized the current views, and have further invented a novel implementation of the ogham letters. Those letters in question shown in FIG. 4. For windchimes according to certain embodiments of the invention, octave adjustments have been made, so that the pitches remain the same. For instance, the letters L, C and O all have the note D, although 2 octaves apart. In one embodiment, one pitch (e.g., D), is a single pitch for all three letters. This process applies to all letters.

Several letters are missing, since they appear in English, but not ancient Irish.

J—in one embodiment, the same is represented by the letter I, since the letter J was a later development of I.

W—in one embodiment, the same is spelled as 2 Us, or "double U."

Letter-Note Equivalents

In one embodiment, the following letter-note equivalents are employed:

| LETTER | NOTE |
|---|---|
| A | E |
| B | E |
| C | D |
| D | F |
| E | B |
| F | C |
| G | A |

-continued

| | |
|---|---|
| H | G |
| I | A |
| J | A |
| K | G |
| L | D |
| M | B |
| N | A |
| O | D |
| P | E |
| Q | C |
| R | F |
| S | B |
| T | E |
| U | C |
| V | C |
| W | C (=UU) |
| X | E |
| Y | G |
| Z | G |

| | | | | | | |
|---|---|---|---|---|---|---|
| Q | L | B | R | K | N | S |
| F | C | T | D | H | G | M |
| U | O | A | | Z | I | E |
| V | | P | | Y | J | |
| | | X | | | | |
| C | D | E | F | G | A | B |

The wind chime (a frame with dangling objects, intended to "catch" the breeze, and gently knock together, creating a soothing sound) is an ancient instrument. Historians and archeologists have found evidence of wind chimes dating back to pre-Historic times, especially in Asia. The name, "wind chime" probably came from ancient China where an instrument called a "chime," consisting of a collections different sized bells which resulted in a variety of tones, was used to create music.

Buddhists, especially, used wind chimes to decorate temples, pagodas and holy places. Besides the obvious sensual attraction, the chimes helped followers achieve a quiet mental state. Different types of chimes, producing differing tones were uses, since they are thought to produce different visceral reactions in the listener. A clear, soft, gentle tone might induce relaxation, while a strident, ringing tone might increase energy in the listener. The Chinese art of Feng Shui uses the graceful, soothing sounds of wind chimes to hasten good energy (chi) through a living or working space.

Perhaps the most compelling research about the effects of music, or soothing sound, has been termed "the Mozart Effect." The foundation for the Mozart effect was published in 1993, when a number of research projects were published, including a study in which college students demonstrated improved spatial-temporal reasoning, after listening to part of Mozart's "Sonata for Two Pianos in D Major".

Wind chimes are used as an element of décor as well. While the most common design of a wind chime today is a circle from which the chiming elements are suspended around a longer strand which contains both a "knocker" (to make the sounds ring) and a "sail" (which catches the wind). Sometimes, the basic design is enhanced with decorative items used above or as part of the circle. Linear designs are also used, which may or may not include a knocker and sail element.

Embodiments of the present invention employ the ancient Celtic notation system with the soothing sound of wind chimes.

Figure 5:
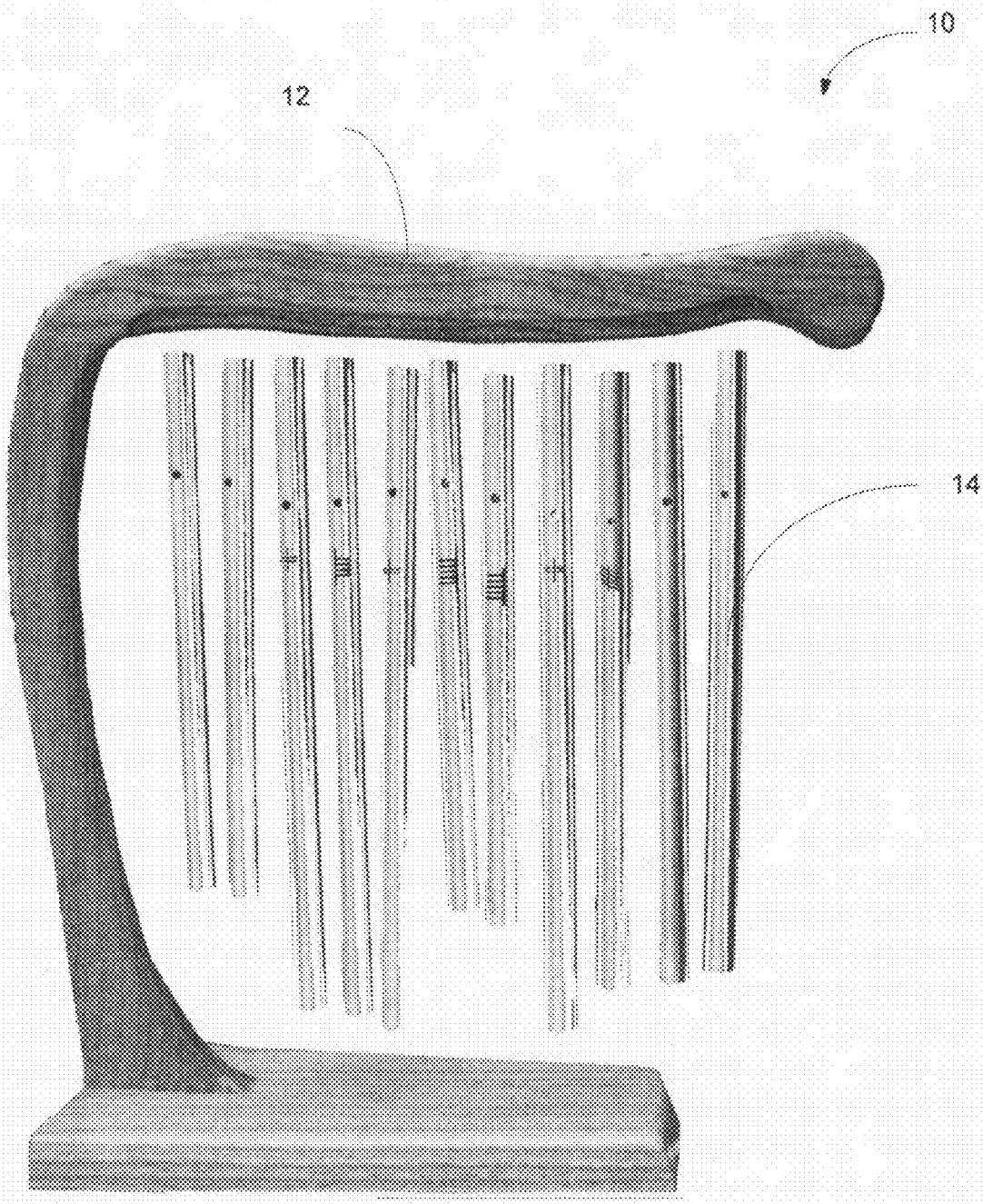
FIG. 5 shows an exemplary embodiment of a wind chime according to the present invention.

FIG. 5 shows an exemplary schematic of the frame construction for the inventive windchime. Referring to that figure, the Wind Chimes 10 may be strung from a frame 12 of natural ash, a wood that is native to Ireland. Other materials may also be employed, such as other woods, metal, plastic, etc. If wood, the wood may be finished with a semi-gloss luster. The frame design may reflect that of the oldest existing Irish harp, on display at Trinity College in Dublin.

The resonating members 14 may be tubes that, e.g., made of ⅝" burnished anodized aluminum, and may be specifically measured, cut and drilled to ring the seven notes starting at middle C, and going up the C scale, which correspond to character/notes represented by Oghams for songs played on the ancient harp. In one embodiment, the longest tube is 9½", and the shortest is 7 13/16". The chimes need not include a sail and knocker element; the tubes respond to a gentle breeze, or the stroke of a hand with a soft, light resonance.

In one embodiment, the aluminum tubes are strung on 15 lb. fishing line. The frame may be shipped with the tubes already attached, in order of the letters according to the English spelling of the name. The owner then has the option of hanging the chime, using, e.g., two screw-in eyes and a 12" chain (provided), or attaching an enclosed pedestal, so that the chime can be used as a decorative item on a table or desk.

Each Wind Chimes unit may be custom-made, using the Ogham character/notes that correspond to a person's name in English. Therefore, when the chime plays, it "sings" the name of the person for whom it was built. The name, written in Ogham characters, reads from left to right on the face of the tubes.

While this description has been written in terms of specific embodiments, the invention is broader than the specific embodiments described. Accordingly, the scope of the invention is to be interpreted solely by the claims appended.

The invention claimed is:

1. A wind chime apparatus, comprising:

a plurality of resonating members for producing audible sound;

a frame for loosely supporting said resonating members spaced from one another such that each said resonating member is free to resonate when struck;

wherein each resonating member corresponds to a tone that is associated with a letter in an ogham musical notation system, and wherein the order of the resonating members spaced from one another corresponds to a name.

2. The apparatus of claim 1, wherein each of the resonating members includes a hollow rigid elongated tube.

3. The apparatus of claim 1, wherein the resonating members are made of a material selected from the group consisting of: metal, wood, plastic, and combinations thereof.

4. The apparatus of claim 1, wherein the frame is made of a material selected from the group consisting of: metal, wood, plastic, and combinations thereof.

5. A method for constructing a wind chime, comprising:

a. providing a frame for a wind chime;

b. receiving a name consisting of at least two letters;

c. associating each of the at least two letters with a resonating members, wherein the associating is accomplished by using a table of musical notes associated with letters in an Ogham musical notation system;

d. attaching the resonating members, in the same order as the letters in the name, to the frame.

6. The method of claim 5, wherein each of the resonating members includes a hollow rigid elongated tube.

7. The method of claim 5, wherein the resonating members are made of a material selected from the group consisting of: metal, wood, plastic, and combinations thereof.

8. The method of claim 5, wherein the frame is made of a material selected from the group consisting of: metal, wood, plastic, and combinations thereof.

9. A kit for a wind chime apparatus, comprising:

a plurality of resonating members for producing audible sound, the plurality representing at least one member associated with each letter in common names;

a frame for loosely supporting said resonating members spaced from one another such that each said resonating member is free to resonate when struck;

wherein each resonating member corresponds to a tone that is associated with a letter in an ogham musical notation system, and wherein the order of the resonating members when attached to the frame corresponds to a name.

* * * * *